United States Patent [19]

Wilmarth

[11] 4,240,493

[45] Dec. 23, 1980

[54] SHELL INVESTMENT CASTING PROCESS

[76] Inventor: Russell F. Wilmarth, R.F.D. #5 Bade River Rd., Bedford, N.H. 03102

[21] Appl. No.: 28,167

[22] Filed: Apr. 9, 1979

[51] Int. Cl.[3] ..... B22C 7/00

[52] U.S. Cl. ..... 164/35; 164/244; 164/246

[58] Field of Search ..... 164/34, 35, 36, 45, 164/244, 249, 246; 141/331; 220/74

[56] References Cited

U.S. PATENT DOCUMENTS

| | | | |
|---|---|---|---|
| 1,405,266 | 1/1922 | Breiel | 141/331 |
| 2,994,931 | 8/1961 | Operhall et al. | 164/246 |
| 3,094,751 | 6/1963 | Horton | 164/36 |
| 3,604,496 | 9/1971 | Grosjean | 164/244 |
| 4,108,931 | 8/1978 | Ogden | 164/36 X |

*Primary Examiner*—Robert D. Baldwin
*Assistant Examiner*—J. Reed Batten, Jr.
*Attorney, Agent, or Firm*—Strimbeck & Soloway

[57] ABSTRACT

In a shell investment casting process a reusable pouring cup form is used. The shell mold is built up around both the pattern and the pouring cup form. When the pattern wax is removed, the pouring cup form is also removed to leave a formed in situ pouring cup. A significant feature is that the pouring cup has a rolled lip that is relatively strong and does not tend to cast debris into the mold. This lip facilitates handling of the shell mold.

2 Claims, 1 Drawing Figure

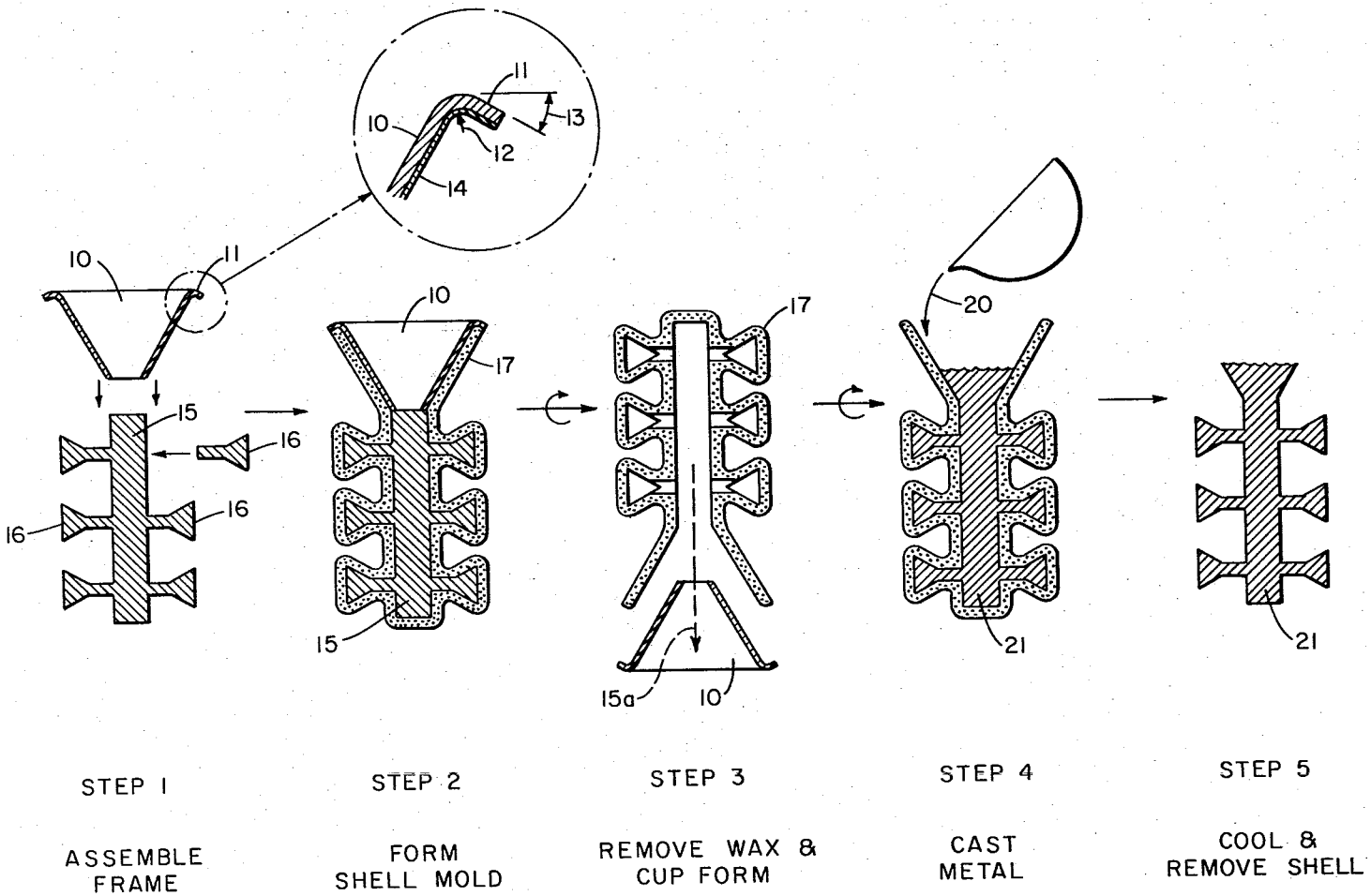
STEP 1
ASSEMBLE FRAME
STEP 2
FORM SHELL MOLD
STEP 3
REMOVE WAX & CUP FORM
STEP 4
CAST METAL
STEP 5
COOL & REMOVE SHELL
10
11
12
13
14
15
15a
16
17
20
21

SHELL INVESTMENT CASTING PROCESS

PRIOR ART

The investment casting or "lost wax" process is well known and practised extensively. This process is fully described in the chapter "Investment Casting", page 237 in the Metals Handbook, Volume 5, Forging and Casting, 8th Edition by the American Society for Metals, Metals Park, Ohio 44073, Library of Congress Catalog No. 27-12046. Interestingly, no mention is made therein of the use of preformed pouring cups and more significantly of the use of pouring cup forms.

BACKGROUND

In shell investment molding a pouring cup may be created at the entrance of the sprue, as illustrated in the Metals Handbook. The solid wax preform shown in the Handbook is undesirable inasmuch as it involves a separate forming step for the preform and causes a lot of wax to be recycled through the process. Also, as shown, the pouring cup or pouring basin formed by this method usually has a thick edge which is fragile and friable and often causes refractory material to fall into the mold.

For this and other reasons, preformed ceramic pouring cups are now being used. These are attached to the shell mold after the shell mold has been formed and are destroyed when the shell mold is removed from about the molded article. This is an expensive practice but is considered justified because of the other advantages offered by the preform. The preform has a stout outer lip which tends to be resistant to damage and crumbling into the mold and the preform and the lip can be used to position and move the shell mold about during the subsequent handling.

The lips of the preformed pouring cups are flat, i.e. the surface of the lip is in a plane perpendicular to the axis of revolution of the pouring cup. This is probably because of the way they are made in that the ceramic is fired while the preform is supported on its lip on a flat surface. Because the lips of the preforms are flat, they tend to allow debris that may come to rest on the lip to find their way into the mold cavity.

THIS INVENTION

In accordance with the present invention, the pouring cup for a shell investment casting mold is formed using a reusable hollow metal conical form. The hollow metal form is attached to the inlet of the sprue when the mold pattern is being assembled. The shell mold is formed by dipping the mold pattern with the attached pouring cup form in a slurry of refractory material in the usual manner with the slurry being allowed to also coat the pouring cup preform. Subsequently, when the pattern wax is removed from the mold, the pouring cup form is removed to leave a pouring cup.

A significant feature of this invention is that the pouring cup form has a reverse rolled outer lip and the shell mold slurry is caused to form up underneath the rolled lip such that when the form is removed, the pouring cup that remains has a strong, smooth, rolled edge on it resistant to chipping and fragmenting. The outer surface of this rolled edge slopes down away from the entrance to the pouring cup at an angle of 15 degrees, preferably 30 degrees, or more to assure that only a minimal amount, if any, of debris can accumulate on the lip of the pouring cup.

More particularly, this invention is concerned with the process of shell investment casting wherein a pattern of the desired object with a sprue is formed of a pattern wax and a shell mold is then formed about the pattern by dipping into a slurry of a refractory powder and drying following which the shell mold is heated to remove the pattern wax. Metal is then cast into the shell mold so formed. The improvement of this comprises forming a pouring cup into the sprue by attaching a hollow conical heat-stable metal pouring cup preform to the inlet of the sprue form when the pattern is being made up. The pouring cup form opens outwardly from the sprue and ends in a reverse rolled lip at the outer edge. The shell mold is then formed in a conventional manner by applying a refractory or ceramic slurry over the pattern including the pouring cup form up to and under the reverse rolled lip. The shell mold is built up to the strength desired in a known manner by repeatingly dipping the pattern and pouring cup form in the slurry, stuccoing and drying. After the shell mold forming step is completed, the pattern wax is removed by melting in the conventional manner and at the same time the pouring cup form is removed to leave a pouring cup with a rolled outer lip and flowing into the sprue.

Preferably, the pouring cup form is coated with a thin layer of a wax meltable at the temperature of the pattern wax when it is assembled such that upon heat fluxing of the shell mold the form is readily removed when the pattern wax melts. This can be the pattern wax but is preferably an inexpensive wax such as a reclaimed wax.

The terms "wax" and "pattern wax" are intended to include true waxes besides the resins, rosins and polymers and mistures thereof customarily used and as are more fully described in the Metals Handbook. The term "cone" includes cylindrical cones as well as pyramidal-shaped cones.

DRAWING

The single sheet of drawing is a schematic illustration of the steps of the present process for making a pouring cup in situ in a shell mold and also to some extent shows details of the pouring cup form.

DESCRIPTION

Referring to the drawing, the reusable pouring cup form 10 can be made of a material such as 18 gauge rolled steel or of aluminum. It is in the form of a truncated cone, the larger, upper edge of which has a reversed rolled lip 11 on it. As an example, this cone may have a top diameter including the lip of 6 inches, a bottom diameter of 3 5/32 inches, and a height of $2\frac{1}{2}$ inches.

The rolled lip 11 preferably has a somewhat generous curvature, i.e., the radius of curvature at 12 is usually at least $\frac{1}{8}$ of an inch and is preferably $\frac{1}{4}$ of an inch or larger, and this helps to form a smooth turned edge on the pouring cup. The rolled lip 11 continues around for a sufficient distance to develop a definite downward slope, i.e. the angle at 13 is at least 15° and more preferably at least 30°. Also, lip 11 continues out far enough to assist in retaining the refractory slurry within the rolled lip when the pattern is rotated about during the shell mold forming step. Having lip 11 sufficiently wide helps prevent dribbling over the edge of the lip. Also, rolled edge 11 can be sized to form a lip of a size and shape that facilitates handling of the shell mold by holding devices in subsequent processing steps.

The outer surface at least of the metal pouring cup form is preferably coated with a thin layer of a wax 14, e.g. this layer can be 0.010 to 0.020 inches thick.

The pouring cup form 10 is attached to the sprue form 15 as illustrated, as are the wax patterns 16 with their gates (Step 1—Assemble Frame). Once the frame is assembled, it is dipped into a ceramic or refractory slurry which can be followed by stuccoing and drying in a known manner to build up the shell mold 17 (Step 2—Form Shell Mold). The shell mold is built up underneath the lip 11 to assure the formation of a good rounded lip on the pouring cup. This is in part accomplished by rotating the frame while it is being allowed to drain over the slurry pot, following which it is stuccoed with a fine refractory sand and put aside to air dry. Six or more coats may be applied in this manner to build up sufficient strength.

After sufficient drying time, say 12 hours, the shell molds have the wax eliminated from them (Step 3—Remove Wax & Cup Form). This can be done for example by placing the shell mold upside down in a steam-fired autoclave and allowing the wax to drain out as indicated by the dashed arrow 15*a*. At the same time, the wax coating on the pouring cup form softens and allows it to be removed. The pouring cup form so removed can then be recoated as may be required with pattern wax and reused. This reusability of the metal pouring cup form results in a significant cost savings as preformed ceramic pouring cups are quite expensive. Also, the preformed pouring cups sometimes may not be available in the size desired. The life of the reusable metal pouring cup form is essentially unlimited as only severe mishandling will damage or destroy it.

Following the melt out of the pattern wax and removal of the pouring cup form, a molten metal as indicated at 20 is cast into the shell mold and allowed to cool until it solidifies to form a casting 21 (Step 4—Cast Metal). Following this, the shell mold is broken away from the casting 21 in a known manner and the casting is further processed as desired (Step 5—Cool & Remove Shell).

By "reverse rolled edge" is meant that edge 11 does not have a sharp corner or crevice in it but is nicely rounded and the sweep of the curve is sufficient to carry around to a downward turn angle of at least 15°, as illustrated. Because of the smooth lip that is formed on the pouring cup the change of foreigh material falling into the mold is reduced. Because of the clean strong rolled edge on the mouth of the pouring cup, the shell mold material does not tend to chip and fall into the mold. The rolled edge or lip on the pouring cup creates a thick edge around the mouth of the mold and gives a good place for support in subsequent handling, e.g. during rotation of the shell mold. The rolled edge extends substantially beyond the outer surface of the pouring cup in order to give this lip for supporting the mold.

What is claimed is:

1. In a process of shell investment casting wherein a pattern of a desired object with a sprue is formed of a pattern wax, a shell mold is formed by dipping said pattern into a slurry of a refractory powder and drying, said shell mold is heated to remove said pattern wax and said object is subsequently cast in said shell mold; the improved method of forming a pouring cup into said sprue comprising attaching a hollow conical metal pouring cup form to the inlet of said sprue form, said pouring cup form opening outwardly therefrom and having a reverse rolled lip on the larger end, forming said shell mold as aforesaid and applying said slurry over said pouring cup form and up to and under said reverse rolled lip and when removing said pattern wax also removing said pouring cup form to leave a pouring cup with a rolled outer lip leading into the sprue, said rolled outer lip extending substantially beyond the outer surface of said pouring cup.

2. The method of claim 1 wherein the outer surface of said pouring cup form is precoated with a thin layer of a wax.

* * * * *